US006068526A

United States Patent [19]

Nottrott et al.

[11] Patent Number: 6,068,526

[45] Date of Patent: May 30, 2000

[54] CONNECTOR BUSHING HAVING AN IMPROVED CENTRAL BASE ZONE

[75] Inventors: Rudolf Nottrott, Nuremberg; Hans Moser, Geisenfeld; Anton Lehner, Karlskron, all of Germany

[73] Assignee: Framatome Connectors International, Courbevoie, France

[21] Appl. No.: 09/202,170

[22] PCT Filed: Jun. 16, 1997

[86] PCT No.: PCT/EP97/03117

§ 371 Date: Dec. 9, 1998

§ 102(e) Date: Dec. 9, 1998

[87] PCT Pub. No.: WO97/49145

PCT Pub. Date: Dec. 24, 1997

[30] Foreign Application Priority Data

Jun. 17, 1996 [DE] Germany ..... 196 24 086
Jun. 17, 1996 [DE] Germany ..... 196 24 088

[51] Int. Cl.[7] ..... H01R 13/187

[52] U.S. Cl. ..... 439/845

[58] Field of Search ..... 439/845; 77/842

[56] References Cited

U.S. PATENT DOCUMENTS

| | | | |
|---|---|---|---|
| 4,550,963 | 11/1985 | Moors | 439/170 |
| 4,932,877 | 6/1990 | Zinn | 439/839 |
| 5,281,178 | 1/1994 | Biscorner | 439/845 |

FOREIGN PATENT DOCUMENTS

| | | | |
|---|---|---|---|
| 0573825 A1 | 12/1993 | European Pat. Off. . | |
| 0601564 A2 | 6/1994 | European Pat. Off. . | |
| 0706236 A1 | 10/1996 | Germany | H01R 4/24 |
| 196 24 086 C2 | 2/1999 | Germany | H01R 13/11 |
| 196 24 088 C2 | 2/1999 | Germany | H01R 13/11 |
| 2 225 183 | 5/1990 | United Kingdom | H01R 13/187 |

OTHER PUBLICATIONS

PCT International Search Report Sep. 1997 (No Date).

*Primary Examiner*—Lincoln Donovan
*Assistant Examiner*—Michael C. Zarroli
*Attorney, Agent, or Firm*—Perman & Green, LLP

[57] ABSTRACT

This invention relates to a connector bushing (1) comprising a plug-in zone (2) and a cable connection zone (3), the plug-in zone (2) being formed as a bushing (4) with a base (5), two side walls **(7*a*, 7*b*) bent from the base (5), and first and second roof halves (8*a*, 8*b*) which start from the side walls and have free ends (9*a*, 9*b*) which are bent over towards the interior of the bushing. The connector bushing (1) comprises a central base zone (20) following the plug-in zone (2), being formed in the shape of a box with a base part in extension of the base of the plug-in zone with side walls in extension of the side walls of the plug-in zone and with a roof zone which is formed by third and fourth roof halves (18, 19)** which are formed by bending over the side walls of the central base zone.

12 Claims, 4 Drawing Sheets

CONNECTOR BUSHING HAVING AN IMPROVED CENTRAL BASE ZONE

BACKGROUND OF THE INVENTION

This invention relates to a connector bushing. Such a connector bushing has been known from EP 573 825 A1 and FR-1 560 917 A1 as well as from DE-OS 1 904 354 and DE-4 314 363 C2. Connector bushings of this kind are used particularly where high contact pressure between the bushing parts and the pin introduced therein is important. Such connectors have also proved satisfactory in applications in which the connection is subject to considerable vibration.

Although conventional connector bushings of this kind already ensure high contact pressures on the introduced pin, this does not automatically result in good electrical contact, particularly if there has been slight tilting on introduction of the pin, in cases where such tilting cannot be automatically corrected. The resulting transition resistance and any local overheating and subsequent risk of oxidation impair the conductivity of this connection.

German utility model 8 811 020 describes a surmounting spring for preventing the connector bushing from spreading apart.

SUMMARY OF THE INVENTION

This invention is based on the problem of improving a connector bushing of the type referred to in such manner as to ensure high contact pressure on the pin while ensuring high conductivity of the connection.

This problem is solved in accordance with the claimed invention. In accordance with this invention a connector bushing comprises a plug-in zone and a cable connection zone. The plug-in zone is formed as a bushing with a base, two side walls bent from the base, and first and second roof halves which start from the side wall and have free ends which are bent over towards the interior of the bushing. In accordance with this invention the connector bushing further comprises a central base zone following the plug-in zone which is formed in the shape of a box, with a base part comprising an extension of the base of the plug-in zone and with side walls comprising an extension of the side walls of the plug-in zone. The central base zone further includes a roof zone which is formed by third and fourth roof halves which are formed by bending over the side walls of the central base zone.

In accordance with this invention ribs are provided in the base of the connector bushing, in order to reliably insure adequate contact surfaces for the contact and prevent deformation of the connector bushing by surrounding it in a rigid cage. This decisively improves the contact pressure and electrical conductivity of the connector bushing according to the invention.

BRIEF DESCRIPTION OF THE DRAWINGS

One exemplified embodiment of a pin bushing according to the invention will be explained hereinafter with reference to the drawing wherein.

DETAILED DESCRIPTION

Figure 1:
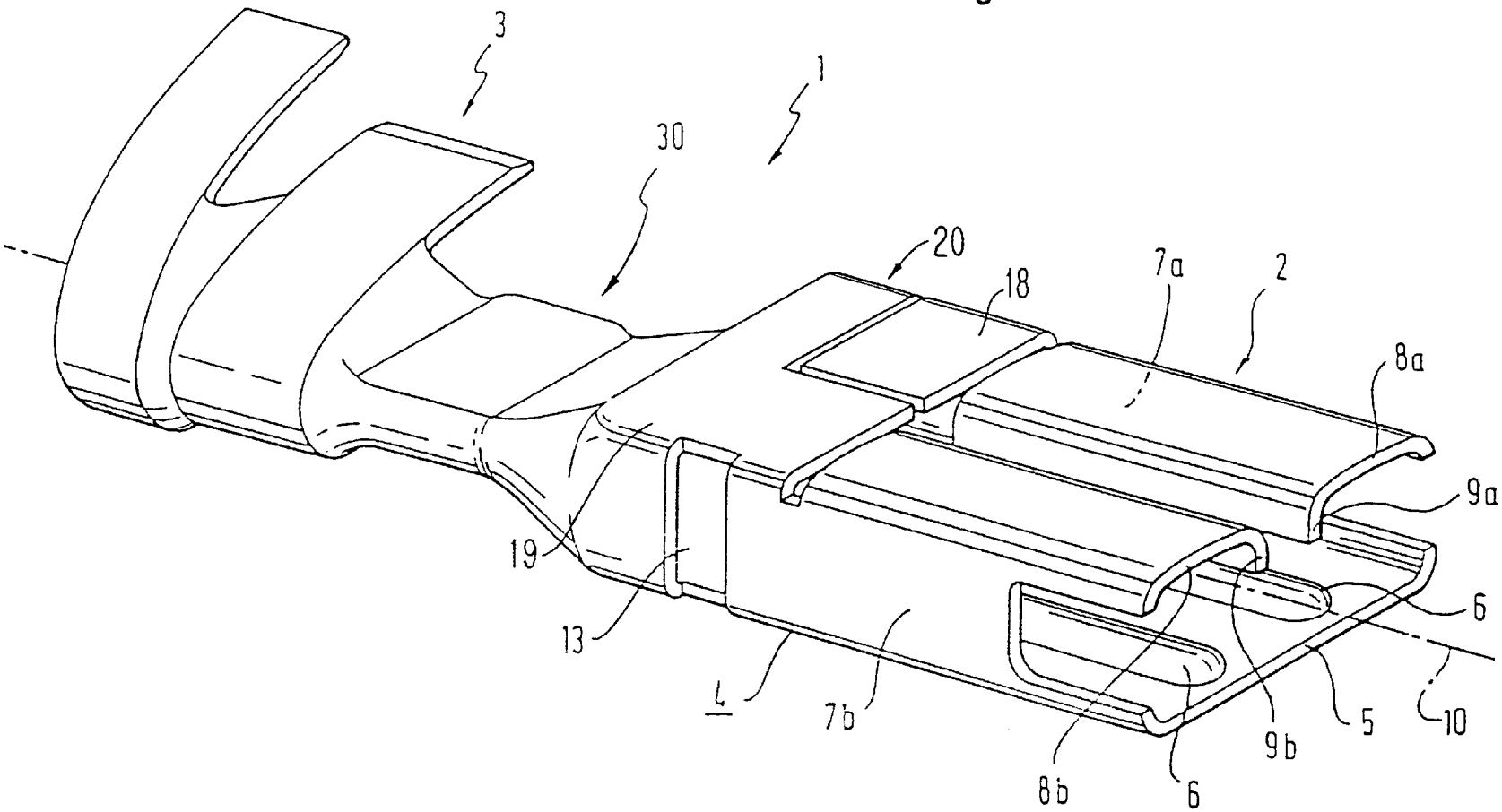
FIG. 1 shows a pin bushing according to the invention in perspective.

The connector 1 shown in FIG. 1 comprises a plug-in zone 2, a central base zone 20, a flattened U-shape zone 30 and a cable connection zone 3. The plug-in zone 2 is formed as a bushing 4, having a base 5 in which two ribs 6 are stamped, which project towards the interiour of the bushing and each extend parallel to the longitudinal centre-line 10 of the connector. Side walls 7*a*, 7*b* are bent over at 90° at the two longitudinal edges of the base and adjoining the top edge of each is a roof half 8*a*, 8*b*, the front edges of which are again bent over towards the interior of the bushing, the front edges extending parallel to one another and parallel to the surface of the base.

The cable connection zone 3 is formed as a crimp connection here, but this is only one of numerous possibilities depending on the problem involved.

An opening 13 is visible in the side wall 7*b* in the rear zone of the bushing and there is a corresponding opening on the opposite side 7*a*. The side walls 7*a* and 7*b* also recede somewhat relative to the base 5 and the roof 8*a*, 8*b* in the front plug-in zone. The cable connection zone has a U-shaped cross-section, the base side extending parallel to the side wall 7*b* of the bushing part. The side wall of the central base zone 20 also extends in U-shape zone 30 in extension of the side wall 7*b* and the base part of the cable connection zone 3.

Figure 3:
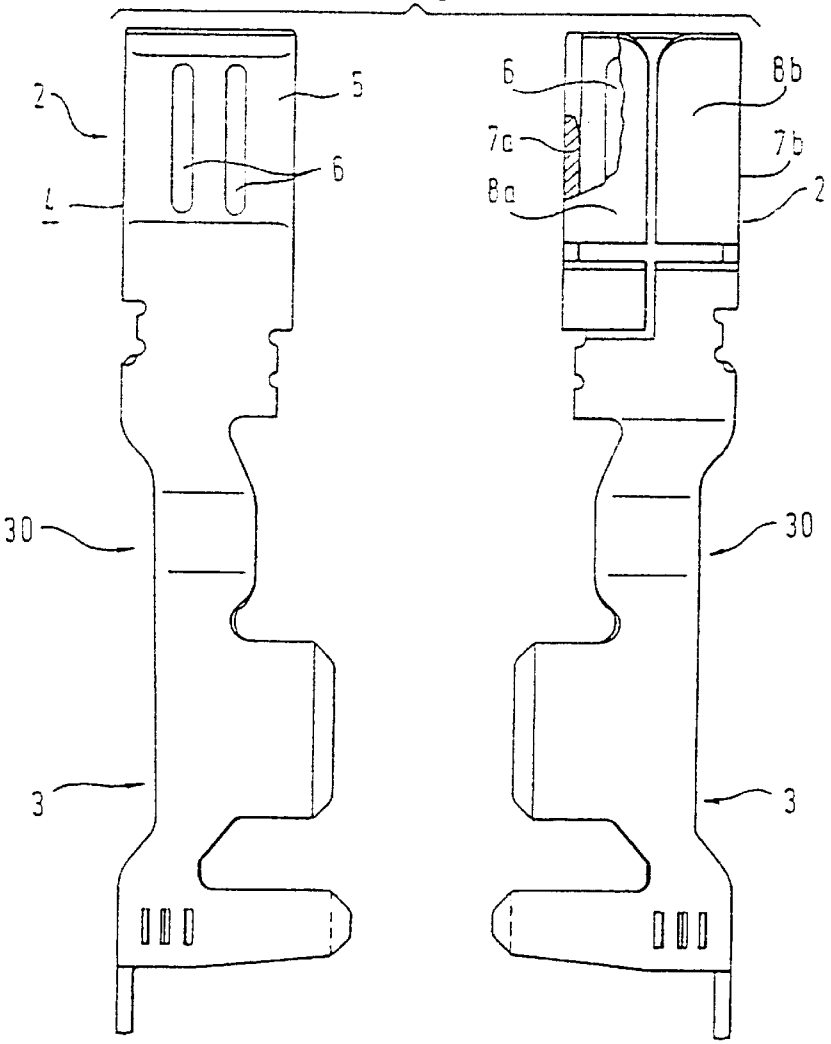
FIG. 3 shows the connector bushing of FIG. 1 seen from below and above.

As will be seen particularly from FIG. 3, the above-mentioned side walls, which are each in alignment with one another, thus form the "spine" of the connector according to the invention.

Figure 2:
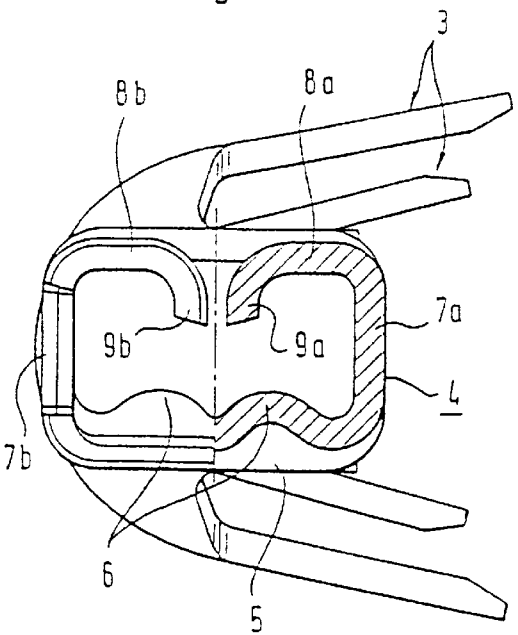
FIG. 2 is a partial section and plan view along the longitudinal centre-line in the region of the bushing.

FIG. 2 is a partial section of the bushing zone and the crimp tags of the cable connection zone 3. The ribs 6 are stamped with a relatively considerable bend radius parallel to one another and parallel to the longitudinal centre-line of the connector in the base 5 of the bushing zone. The distance between them is greater than the distance between the end edges 9*a*, 9*b* of the roof halves 8*a*, 8*b*. This configuration ensures that the pin to be introduced has a large contact surface on the back of the ribs 6 and the front edges 9*a*, 9*b* of the roof halves 8*a*, 8*b*. In particular, this prevents an edge of the pin tilting obliquely in the region of the curve between the base 5 and the side wall 7*a*, 7*b* so that the contact is restricted to the burr at the stamped edges of the pin between the latter and the bushing.

The front edges of the roof halves 8*a*, 8*b* are pressed on to the pin with a certain resilient force, practically the entire zone, side walls and roof being operative as spring arms.

Figure 4:
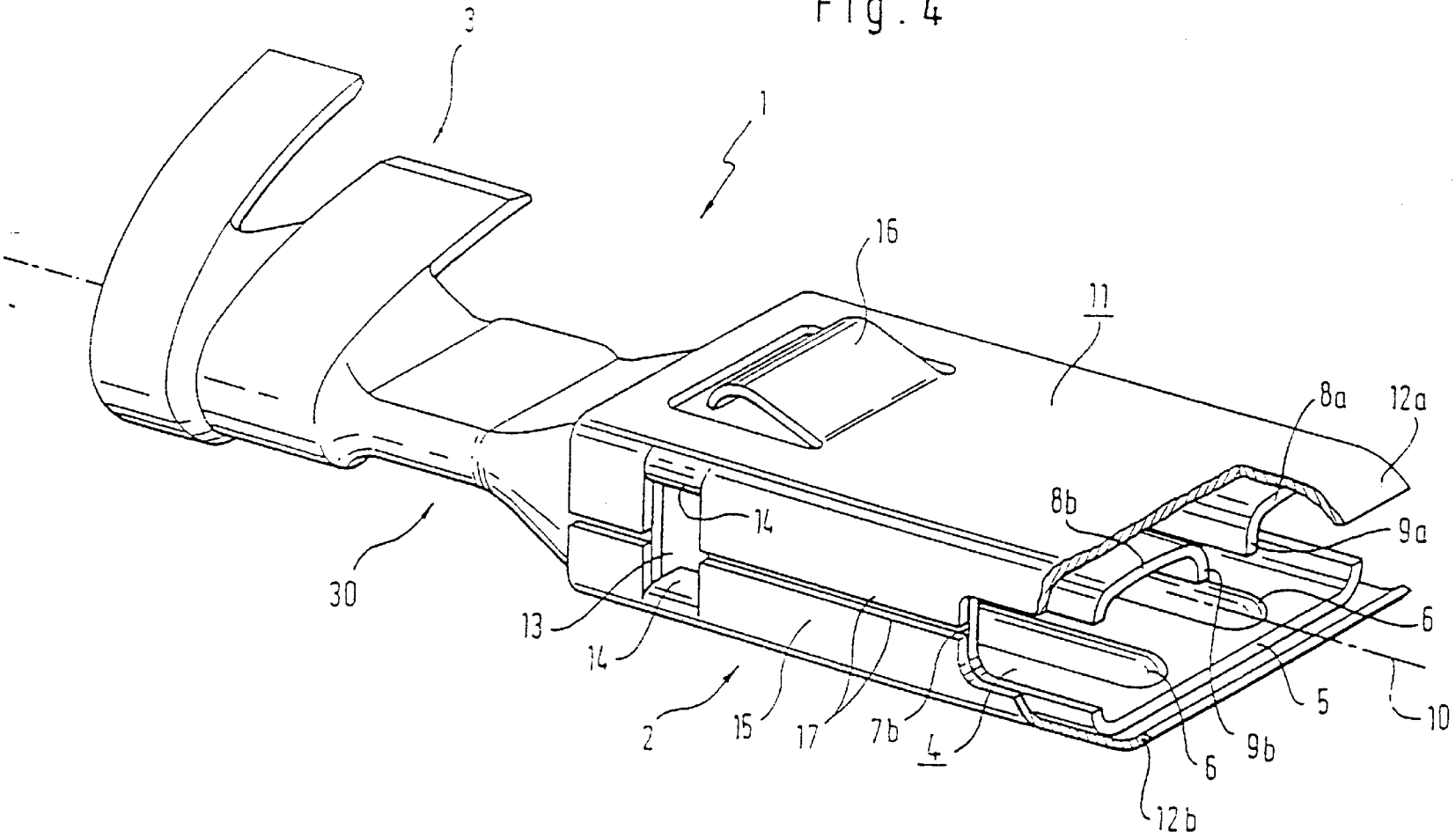
FIG. 4 shows the connector of FIG. 1 with the box-shaped surmounting spring.
Figure 5:
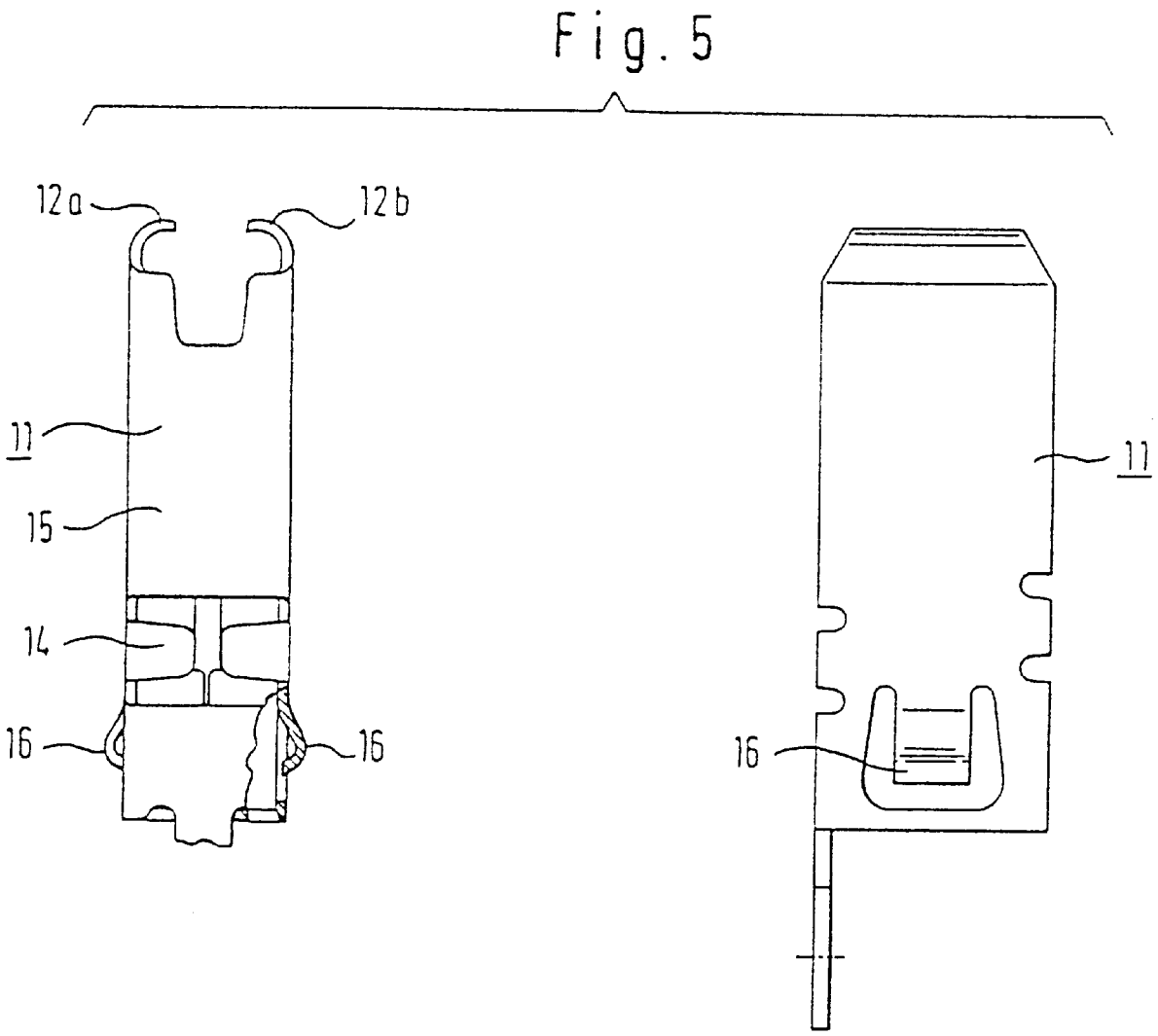
FIG. 5 shows the surmounting spring of FIG. 4 in side view and plan view.

To prevent excessive deformation of the bushing and increase the rigidity of the fit of the pin in the bushing, the latter is surrounded by a surmounting spring 11 as shown in FIG. 4. The latter may be made from a hard elastic material, e.g. steel. It has the shape of a box and inwardly bent spring strips which are rounded in the end zone. These spring strips 12*a*, 12*b* protect the pin from contact with the front edges of the ribs and the axial bends.

Inwardly bent lugs of the side walls of the surmounting spring 11 engage in the windows 13, which are formed in the rear end of the bushing zone of the connector, in order to fix the spring on the connector. The spring has recesses in the side walls just like the side walls 7*a* and 7*b* in the region of the front opening of the bushing. This provides a means of observing the introduction process and allows a certain elasticity of the base and roof zones of the bushing in the event of a pin being inserted with slight tilting. Locking arms 16 are also formed in the rear zone of the spring in the roof zone and, if required, in the bottom zone, the free ends of the locking arms being bent obliquely rearwards towards the bushing in order to ensure releasable locking in a plug casing. The spring 11 is of substantially box shape and the edges 17 of the bentover metal sheet abut one another in parallel relationship in the middle of a side wall 7*b*.

The connector bushing according to the invention is extremely compact and has amazingly high rigidity as a result of a number of steps. On the one hand, the shifting of the base side from which the adjoining walls are bent is prevented towards one side so that the opening of the bushing, possibly after the side walls have yielded to the introduction of a pin, can continue into the middle zone of the base and then on into the cable connection zone, so that increased rigidity is obtained for this reason alone. The box-shaped cage formed by the spring 11 in turn has its side which is weaker to deformation situated where the backbone of the connector is situated, so that here again a rigid and effective support is ensured.

The above description of one exemplified embodiment has no limiting force but serves solely to explain the present invention.

What is claimed is:

1. A connector bushing comprising:

a plug-in zone and a cable connection zone, the plug-in zone being formed as a bushing with a base, two side walls bent from the base, and first and second roof halves which start from the side walls and have free ends which are bent over towards the interior of the bushing, the connector bushing comprising a central base zone following the plug-in zone, said central base zone being formed in the shape of a box with a base part in extension of the base of the plug-in zone with site walls in extension of the side walls of the plug-in zone and with a roof zone which is formed by third and fourth roof halves which are formed by bending over the side walls of the central base zone, said cable connection zone being connected to the central base zone via a flattened U-shaped zone which has side walls each of which starts from the base of the central base zone and the roof of the central base zone.

2. A connector bushing comprising:

a plug-in zone and a cable connection zone, the plug-in zone being formed as a bushing with a base, two side walls bent from the base, and first and second roof halves which start from the side walls and have free ends which are bent over towards the interior of the bushing, the connector bushing comprising a central base zone following the plug-in zone, said central base zone being formed in the shape of a box, with a base part in extension of the base of the plug in zone, with side walls in extension of the side walls of the plug in zone and with a roof zone which is formed by third and fourth roof halves which are formed by bending over the side walls of the central base zone, said cable connection zone being connected to the central base zone via a flattened U-shaped zone which has side walls each of which starts from the base of the central base zone and the roof of the central base zone, said third roof half having an extension which serves as an abutment for said fourth roof half.

3. A connector bushing according to claim 2, wherein the plug-in zone and the central base zone are embraced by a cage which encloses the plug-in zone in the shape of a box in order to prevent the side walls from opening towards the outside and in order to restrict the opening of the first and second roof halves.

4. A connector bushing according to claim 3, wherein the cage has side walls which have inwardly bent tags which mesh with openings which are formed in the side walls of the central base zone.

5. A connector bushing according to claim 4, wherein the cage consists of a folded metal sheet and the edges of the folded metal sheet abut on one side wall of the plug-in zone.

6. A connector bushing according to claim 5, wherein the cage has spring tongues which are bent inwardly at the front side of the base and of the roof of the plug-in zone.

7. A connector bushing according to claim 6 wherein the base of the plug-in zone has at least one rib extending in parallel to a plug-in direction, which projects into the interior of the bushing.

8. A connector bushing according to claim 1, wherein the plug-in zone and the central base zone are embraced by a cage which encloses the plug-in zone in the shape of a box in order to prevent the side walls from opening towards the outside and in order to restrict the opening of the first and second roof halves.

9. A connector bushing according to claim 8, wherein the cage has side walls which have inwardly bent tags which mesh with openings which are formed in the side walls of the central base zone.

10. A connector bushing according to claim 9, wherein the cage consists of a folded metal sheet and the edges of the folded metal sheet abut on one side wall of the plug-in zone.

11. A connector bushing according to claim 10, wherein the cage has spring tongues which are bent inwardly at the front side of the base and of the roof of the plug-in zone.

12. A connector bushing according to claim 1, wherein the base of the plug-in zone has at least one rib extending in parallel to a plug-in direction, which projects into the interior of the bushing.

* * * * *